United States Patent [19]

Ginzburg et al.

[11] Patent Number: 4,761,983

[45] Date of Patent: Aug. 9, 1988

[54] METHOD AND APPARATUS FOR WINDING MATERIAL ON A DRUM

[75] Inventors: Vladimir B. Ginzburg, Pittsburgh; Richard C. DeChellis, McMurray; Robert H. Ellis, Oakmont, all of Pa.

[73] Assignees: International Rolling Mill Consultants, Inc.; United Engineering, Inc., both of Pittsburgh, Pa.

[21] Appl. No.: 82,489

[22] Filed: Aug. 7, 1987

[51] Int. Cl.[4] ..... B21C 47/06

[52] U.S. Cl. ..... 72/148; 72/202

[58] Field of Search ..... 72/146, 148, 371, 200, 72/202; 242/78.1, 78.3

[56] References Cited

U.S. PATENT DOCUMENTS

| | | | |
|---|---|---|---|
| 2,161,076 | 6/1939 | Morgan | 72/146 |
| 2,325,559 | 7/1943 | Washam, Jr. | 242/78 |
| 2,675,720 | 4/1954 | Ferm | 80/32 |
| 3,001,737 | 9/1961 | Tracy | 242/78.4 |
| 3,098,619 | 7/1963 | Washburn | 242/78.4 |
| 3,122,337 | 2/1964 | Boron | 242/78.1 |
| 3,613,426 | 10/1971 | Adair et al. | 72/202 |
| 4,005,830 | 2/1977 | Smith | 72/146 X |
| 4,442,690 | 4/1984 | Hirschmanner et al. | 72/148 X |
| 4,455,848 | 6/1984 | Tippins | 72/12 |
| 4,485,651 | 12/1984 | Tippins | 72/12 |

FOREIGN PATENT DOCUMENTS

| | | | |
|---|---|---|---|
| 517351 | 6/1976 | U.S.S.R. | 72/148 |

OTHER PUBLICATIONS

"The Reversing Hot Strip Mill", by A. F. Kenyon, Iron and Steel Engineer Year Book, 1953, pp. 410–418.

"Electric Equipment for Reversing Hot Strip Mills", by C. C. Thomas, Iron and Steel Engineer Year Book, pp. 904–921.

*Primary Examiner*—E. Michael Combs

*Attorney, Agent, or Firm*—Suzanne Kikel

[57] ABSTRACT

An arrangement for winding material onto a coiler drum along a passline of a hot reversing mill comprising an apparatus having two pivotal arms mounted on a common shaft and movable in a different arcuate path toward and away from the coiler drum. Rollers at the end of the arms tightly enwrap the material around the drum when the arms are positioned against the drum as the material is being underwound onto the drum. The roller of one of the arms may act as a deflector roller when positioned away from the drum as the material is being overwound onto the drum. The other arm consists of two wrapper rollers on a pivotal mounting for their proper orientation around the drum and for flat passes of the material through the mill. This other arm is positioned away from the drum below the passline to allow a retractable table roll assembly consisting of a plurality of table rolls to be positioned in the passline for supporting the material.

19 Claims, 4 Drawing Sheets

METHOD AND APPARATUS FOR WINDING MATERIAL ON A DRUM

BACKGROUND OF THE INVENTION

1. Field of the Invention

The invention relates to coilers for strip-like material, and more particularly to the underwinding or overwinding of the material onto coiler drums located on opposite sides of a hot reversing mill.

2. Description of the Prior Art

Hot reversing mills for plate and strip having coiler furnaces on opposing sides thereof are employed in semi-continuous mills and as mini-mills for processing metal slabs, such as steel into a hot rolled product.

Conventionally, coilers are operated in one of two ways, either to overwind or underwind the material onto the drum, in which the leading end of the strip is engaged in a slot in the drum, and the drum is rotated in a direction to cause the desired type of winding onto the drum. In such systems, especially in underwinding strip onto the drum, it has been known to provide a tiltable table roll assembly with fixed table roll mountings, which roll assembly in the coiling operation is pivoted upwardly toward the drum either to retain the strip against a portion of the drum, as exemplified in U.S. Pat. Nos. 4,455,848 and 4,485,651; or to convey the leading end of the strip into the slot of the drum or the tailing end of the strip into the mill, as exemplified in U.S. Pat. No. 3,613,426. In an overwinding system, it is conventional to provide a pivotal arm swingable in and out of the furnace and having a single roll assembly for engaging against the periphery and a fixed roll assembly mounted in the furnace for guiding the strip upon its winding onto the mandrel as exemplified in U.S. Pat. No. 2,675,720.

Several problems arise in these known systems, such as overheating of the table rolls, especially the tiltable roll assembly when in its passline positioning or in its positioning adjacent to the drum located in the coiling furnace. The location of the table roll assembly for supporting the strip onto the mandrel and the fact that the table roll assembly of the prior art is fixedly mounted preventing proper orientation of the rolls around the periphery of the mandrel results in slippage of the leading end of the strip from the slot of the drum before the first wrap is completed around the drum; and/or inadequate wrapping of the strip onto the mandrel. The table roll assemblies cooperating with the coiler and the guide rolls in the furnace of the prior art are such that they remain in a fixed position relative to the passline or in the coiler furnace and cannot be easily removed upon repair and maintenance of the coiler, the furnace, or the rolls themselves.

SUMMARY OF THE INVENTION

The present invention has solved the above-described problems existing in the prior art.

The present invention provides for a retractable table roll assembly located in proximity to the coiler furnace and which is positionable in alignment with the passline of the strip thereby being a part of the series of table rolls for the flat passes of the strip, or which can be moved perpendicularly relative to the passline out from under the coiler furnace during the coiling operation of the strip or on any occasion when the table is not in use and it is desired to minimize the table section being subject to the furnace heat.

The present invention also provides two pivotal arms mounted on a common shaft and carrying wrapper rollers. A wrapper roller of a first pivotal arm is moved into position adjacent to the drum to wrap the strip during underwinding of the strip thereon, or is moved out of position away from the drum to deflect the strip in an overwinding operation. The wrapper rollers of a second pivotal arm are pivotally mounted on a cradle such as to situate themselves for engaging and adequately wrapping the strip around the periphery of the coiler drum during both an underwinding or overwinding of the strip. In an inoperative mode, this second pivotal arm is positioned below the passline in a remote location so that the retractable table roll assembly can be moved into position along the passline to become part of a series of table rolls for supporting the workpiece.

It is a broader object of the invention to provide a method and apparatus for optimumly tensioning and adequately wrapping the leading end of the material and particularly the first few wraps of the coil in either an overwinding or an underwinding operation.

It is a still further object of the invention to provide a roller means and a method thereof for locating the roller means in two different strategic locations relative to the periphery of the coiler drum.

More particularly, it is an object of the invention to provide two roller means located in strategic positions relative to the slot in the coiler drum, one of the roller means being located in the first quadrant downstream from the slot and the other roller means located in close proximity to the adjacent edge of the slot in the fourth quadrant of the coiler drum, and to provide a method thereof.

A further object of the invention is to provide wrapper rollers and table rollers near the coiler which can be easily movable for maintenance and repair of the rolling mill equipment.

A further object of the invention is to provide a movable guide roller which conventionally was fixed in the coiler furnace, and which is now positionable into several locations both in and out of the furnace These objects, as well as other novel features and advantages, of the present invention will become better appreciated and understood when the following description of a preferred embodiment is read along with the accompanying drawings of which:

DESCRIPTION OF A PREFERRED EMBODIMENT

The present invention is typically employed in a hot reversing mill for reducing a hot workpiece, such as a carbon or stainless steel slab or strip, where after several flat passes the elongated workpiece is finally coiled in a coiler furnace where heat losses are reduced.

Figure 1:
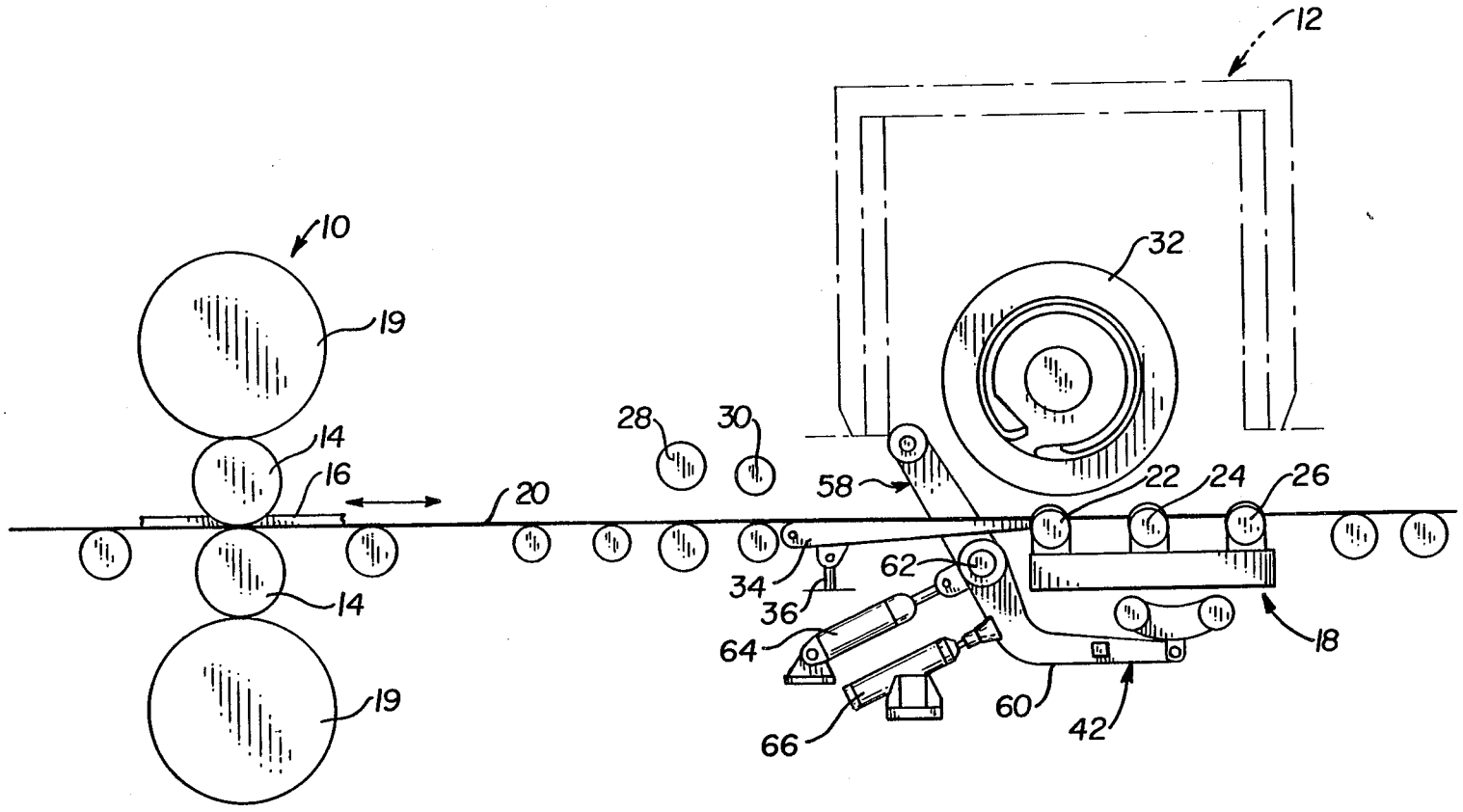
FIG. 1 is a partial schematic elevational view of a hot reversing mill employing the invention.

FIG. 1 illustrates in schematic form, such a reversing mill 10, and one of two coiler furnaces, which coiler furnace 12 is located to the right of FIG. 1. A similar coiler furnace (not shown) is also provided to the left of mill 10. Reversing mill 10 includes a pair of work rolls 14 between which a workpiece 16 travels, and a pair of backup rolls 19 supporting the work rolls 14. Between mill 10 and coiler furnace 12 is a series of table rollers for defining a passline indicated by line 20 and supporting workpiece 16. A table assembly 18 is located beneath coiler furnace 12 where it becomes part of the passline. Table assembly 18 comprises table rollers 22, 24, and 26, which will be discussed in detail shortly.

Also, a pinch roll unit 28 and a deflector roll unit 30 shown in their open position are located between mill 10 and coiler furnace 12. Coiler furnace 12 consists of a coiler drum 32. An apron 34 partially defining the passline along with table assembly 18 is associated with coiler drum 32 and is operated through an hydraulic piston cylinder assembly 36 positioned beneath the passline 20. Apron 34 is adapted to be pivoted upwardly to deflect workpiece 16 out of the passline 20 and onto drum 32 for coiling of the workpiece 16 thereon.

Figure 2:
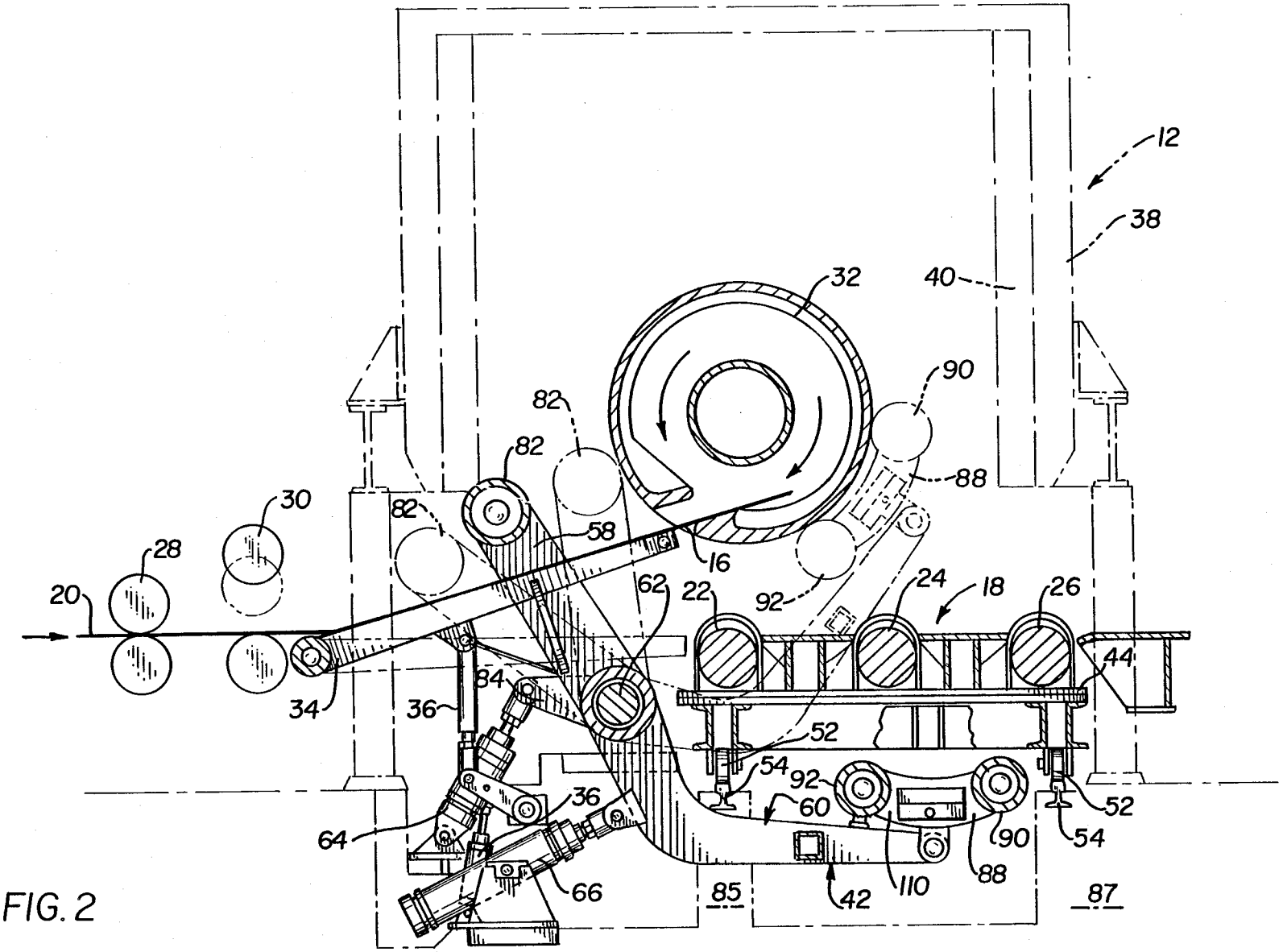
FIG. 2 is an enlarged section elevational view taken along lines 2—2 of FIG. 3.

Coiler furnace 12 may follow a number of well-known designs, and generally comprises an outer frame 38 and an inner refractory chamber 40, as seen in FIG. 2.

As will be appreciated, the above-described components of the hot reversing mill arrangement and their operation, in addition to the coiler furnace 12, which would be the drum 32, the pinch roll unit 28, the deflector roll unit 30, apron 34, and several of the table rollers particularly those between mill 10 and coiler furnace 12, as are other illustrated components thereof, are well-known in the art as exemplified in the aforesaid U.S. Pat. Nos. 2,675,720; 3,613,426; 4,455,848; and 4,485,651, which are incorporated herein by reference. For this reason, the construction and operation of these several well-known components will not be specifically described since this is not necessary to understand the invention.

A description of the invention will now be given with particular reference to FIGS. 2, 3, and 4, which are detailed drawings of the associated components of coiler furnace 12, which includes a winding apparatus 42 located to the right of FIG. 1. It will be appreciated that the left side of reversing mill 10 is similar to the right side and that the coiler furnace and its associated components located to the left of mill 10 in FIG. 1 are similar in construction and operation as that to the right, except for the positioning of its winding apparatus which would be a mirror image to that shown to the right of mill 10. For clarity, the numerals are not included in all of FIGS. 1, 2, 3, and 4.

Figure 3:
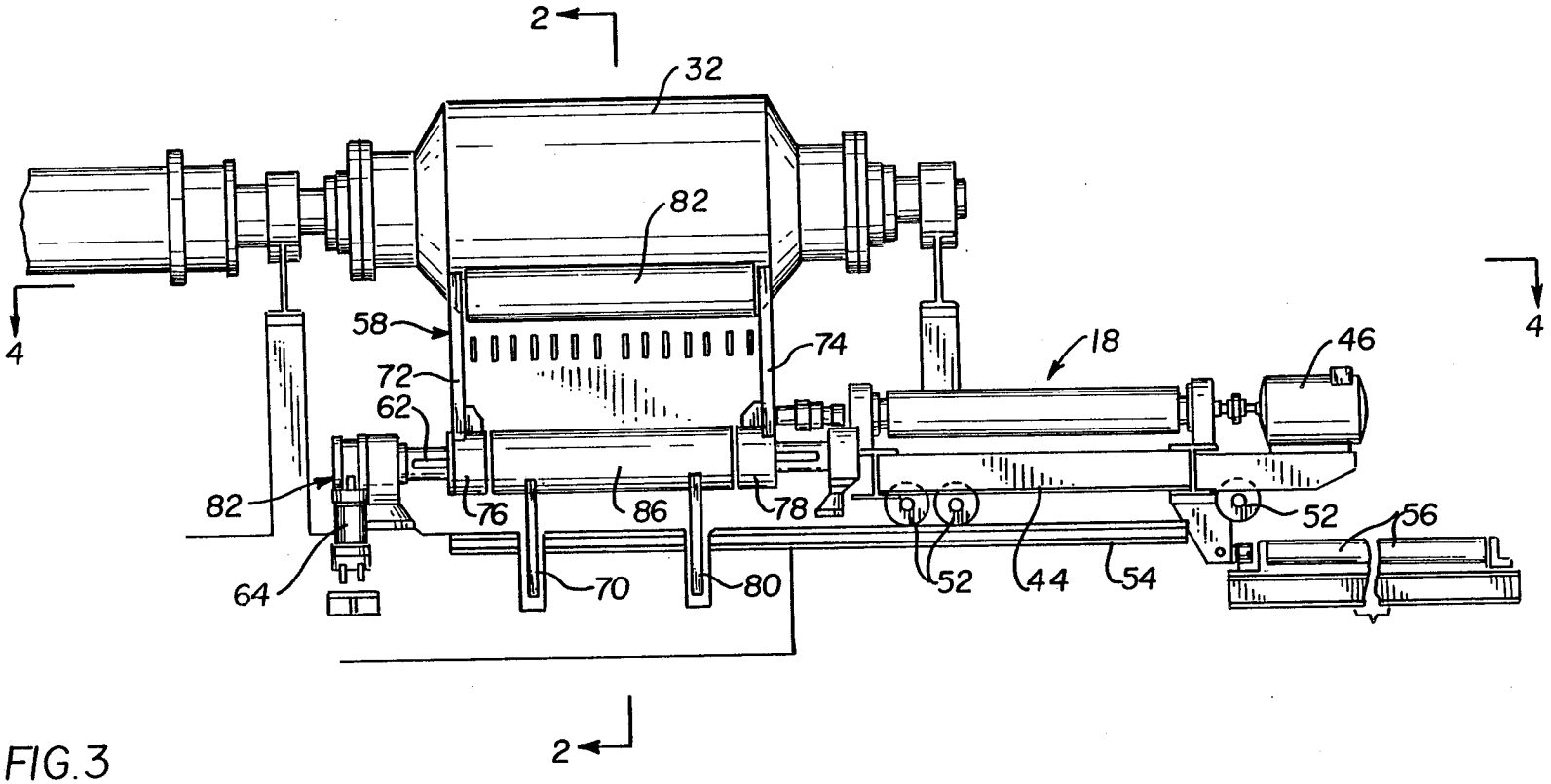
FIG. 3 is a partial elevational view of the entry side of the furnace as shown in FIG. 2.
Figure 4:
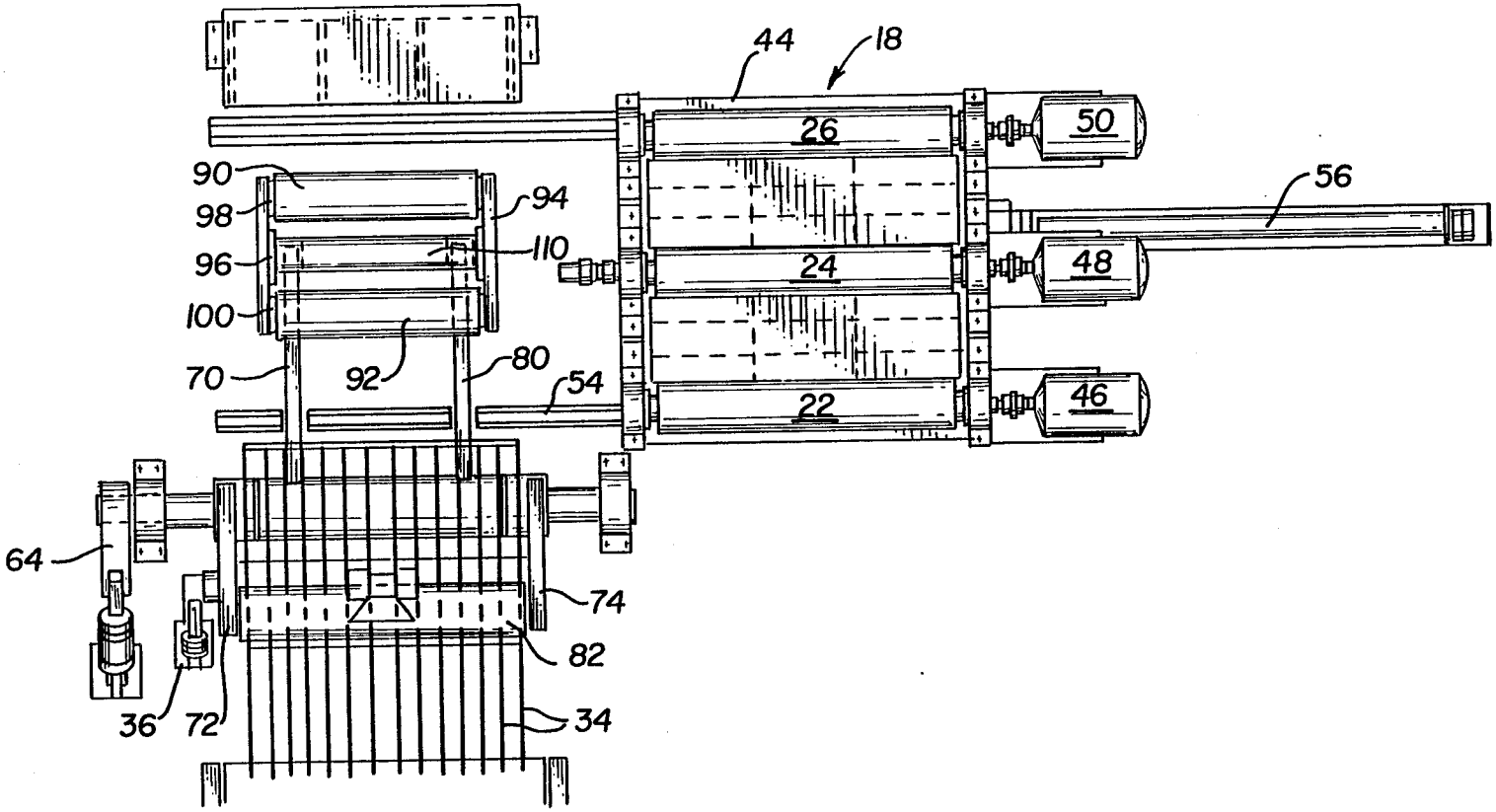
FIG. 4 is a plan view of FIG. 3.

Referring now to FIGS. 2, 3, and 4, the invention generally entails table assembly 18 which is retractable in a perpendicular direction relative to passline 20, and winding apparatus 42 which is adjacent to table assembly 18.

Table assembly 18, as previously mentioned, comprises rotatable rollers 22, 24, 26 which are mounted on structure 44. Each roller 22, 24, 26 is rotated by its respective motor 46, 48, 50 also mounted on structure 44, as best seen in FIG. 4. Structure 44 is caused to travel by wheels 52 on rails or tracks 54 arranged perpendicularly to passline 20, and is caused to be moved in and out of the passline by a hydraulic piston cylinder assembly 56. Table assembly 18 of FIGS. 2, 3 and 4 is in its retracted position perpendicular to and out of the way of passline 20. This is an inoperative positioning or maintenance positioning for table assembly 18 during operation of winding apparatus 42 and also for required maintenance in the coiling of workpiece 16 onto drum 32 for an operative positioning.

Coil winding apparatus 42 comprises a first arm assembly 58 shown in FIG. 2 to be located to the left of table assembly 18 and extending up into and above passline 20, and a second arm assembly 60 which is seen in FIG. 2 to be located below table assembly 18. Both a hard line and a phantom positioning are shown in FIG. 2 for arm assemblies 58 and 60. Arm assemblies 58 and 60 are pivotally mounted on a common shaft assembly 62. The pivotal movement for arm assembly 58 is brought about through operation of hydraulic piston cylinder assembly 64, and likewise, pivotal movement of arm assembly 60 is brought about by hydraulic piston cylinder assembly 66. Arm assemblies 58 and 60 carry at their extreme ends a roller arrangement, which will be discussed in detail shortly.

FIG. 3 illustrates more clearly the construction for arm assemblies 58 and 60 on shaft assembly 62. Arm assembly 58 comprises spaced-apart opposed elongated members 72 and 74, each being independently mounted to a respective collar member 76 and 78. Collar members 76 and 78, in turn, are keyed into the shaft of shaft assembly 62 extending between and beyond opposed elongated members 72 and 74 of arm assembly 58. The roller arrangement of arm assembly 58 consists of a rotatable billy roller 82 mounted through suitable means (not shown) between opposed elongated members 72 and 74. This billy roller 82 of arm assembly 58 replaces the conventional fixed roller in the furnace near its entrance, and is unique in that it can now be positioned in at least two different locations for performing two different functions. In a retracted positioning away from coiler drum 32 shown in hard line in FIG. 2, billy roller 82 is used as a deflector roll for deflecting workpiece 16 during an overwinding of workpiece 16 onto coiler drum 32, which is rotating in a clockwise direction with particular reference to FIG. 2. Billy roller 82 can assume a third positioning out of the furnace 12 which is in an inoperable positioning as shown to extreme left in phantom in FIG. 2. This positioning is performed by its piston cylinder assembly 64.

In an underwinding of workpiece onto drum 32, billy roller 82 is in a wrapping position immediately adjacent to but slightly away from drum 32 as shown in phantom in FIG. 2. This is close to the slot and when the leading end comes around to the fourth quadrant in its first wrap, billy roller 82 makes sure the workpiece 16 stays on the drum, and as the slot passes beyond the roller 82, billy roller 82 further enhances the wrapping of the workpiece during the underwinding operation, i.e. billy roller 82 effects a "tucking" action of the first wrap with the second wrap of the material on drum 32. When tension of workpiece 16 on drum 32 is created, then roller 82 can be moved away from drum 32 to its ambush or inoperative positioning out of the furnace. For this underwinding operation, coiler drum 32 is rotated in a counter-clockwise direction with reference to FIG. 2. As best seen in FIG. 2, hydraulic piston cylinder assembly 64 is connected to arm assembly 58 through a toggle-clevis connection indicated at 84.

A tubular collar 86 (FIG. 3) is mounted around the shaft of shaft assembly 62 and is rotatable thereon through bearing assemblies (not shown). Tubular collar 86 carries arm assembly 60 which is comprised of two opposed spaced-apart curved members 70 and 80, which are best seen in FIGS. 2 and 3 as extending downwardly into a pit below rails 54 for the positioning and movement of table assembly 18. This positioning for arm assembly 60 below table assembly 18 in FIG. 2 is an inoperative positioning for arm assembly 60. As seen in FIG. 3 two wheels 52 are arranged in tandem in the front of table assembly 18 so that when assembly 18 is moved to the left of FIG. 3 in its positioning in passline 20, one wheel 52 is positioned in the gaps of the rails 54 while the other wheel 52 is supported by rail 54. This allows for easy maneuverability of table assembly into and out of the passline.

As seen in FIGS. 2 and 3, rails 54, and therefore table assembly 18 are supported by sections of the foundation of the mill arrangement, which sections are indicated at 85 and 87 in FIG. 2.

As shown in FIG. 2, section 85 has cutout portions for receiving curved members 70 and 80 of arm assembly 60. The wrapper roller arrangement mounted at the ends of spaced-apart curved members 70 and 80 of arm assembly 60 comprises a pivotally mounted cradle 88 (FIG. 2) carrying two opposed rollers 90 and 92 (FIGS. 2 and 4). These rollers 90 and 92 are freely mounted for rotation through suitable means in cradle 88 as particularly seen in FIG. 4.

As seen in this FIG. 4, cradle 88 consists of members 94 and 96 carrying shafts 98 and 100 which, in turn, support rollers 90 and 92, respectively. Members 94 and 96 are connected together by cross member 110. Member 110 has a clevis on each end for its pivotal connection to curved members 70 and 80 of arm assembly 60, which pivotal connection allows rollers 90 and 92 to rock about a pivot so as to allow the proper orientation for rollers 90 and 92 around coiler drum 32 thereby providing an adequate initial wrapping and subsequent wrappings of workpiece 16. Rollers 90 and 92 are pivoted to articulate about the drum 32 to force the first wrap of workpiece 16 to take the contour of the drum in the first quadrant immediately behind the slot of the drum 32. This arm assembly 60 is brought up from the bottom of the furnace 12 so that the furnace does not have to be cut open, thereby loosing its efficiency in retaining the heat in the furnace.

The rollers 90 and 92 may be used in both an underwinding and/or an overwinding operation for workpiece 16 onto drum 32. This operative positioning of arm assembly 60 is shown in phantom in FIG. 2. Referring particularly to FIGS. 2 and 3, arm assembly 60 is pivoted into this operative phantom positioning as shown best in FIG. 2 by piston cylinder assembly 66.

Referring again to FIGS. 2 and 4, apron 34 extends between elongated members 72 and 74 of arm assembly 58, so that arm assembly 58 can be positioned and remain above passline 20. This permits apron 34 to be pivoted by its hydraulic piston cylinder assembly 36 into a position adjacent to coiler drum 32 in order to guide workpiece 16 onto coiler drum 32, which is rotated so that its slot in a conventional manner can receive the leading end of workpiece 16.

While workpiece 16 is being passed back and forth through mill 10 in its flat passes, table assembly 18 is in its operative positioning in line with passline 20. When workpiece 16 is reduced in thickness so that it can be coiled onto drum 32, table assembly 18 is retracted out of the passline, and apron 34 is pivoted upwardly toward drum 32. With table assembly 18 out of the way, arm assembly 60 can be pivoted upwardly into its phantom position shown in FIG. 2 so that wrapper rollers 90 and 92 can position themselves around the outer periphery of drum 32 slightly downstream of the slot in drum 32 in a manner that they engage and bend workpiece 16, as explained further below when workpiece 16 is being either underwound or overwound around drum 32.

Arm assembly 58 is caused to remain in its hard line positioning acting as a deflector roll if overwinding of the workpiece is being performed, or is moved into its phantom positioning against the outer periphery of drum 32 slightly upstream of the slot in drum 32 if an underwinding of workpiece 16 is being performed. Initially in the coiling operation, arm assemblies 58 and 60 may retain their positioning adjacent the drum 32 in engagement against the several wraps of workpiece 16 after which they are retracted. The piston cylinder assemblies 64 and 66 can be operated effectively to incrementally move arm assemblies 58 and 60 away from drum 32 as the thickness of the coil increases and to do this in such a way that a tight wrapping thereof is being performed.

Optionally, rollers 82, 90, and 92 can be moved out of the furnace 12 in their inoperative positionings so that they cannot be detrimentally affected by the heat in the furnace.

It is to be appreciated that rollers 90 and 92 can be moved below the passline 20 for easy replacement and out of the direct heat of the furnace. Rollers 90 and 92 as mentioned previously are brought up from the bottom of the furnace when table assembly 18 is moved out of the passline. It is further emphasized that roller 82 can also be moved out of the furnace and easily replaced.

In the coiling operation, after threading of workpiece 16 apron 34 will generally return to its upward positioning. When uncoiling of workpiece 16 on drum 32 is to be performed, arm assembly 58 will be moved in its deflector roll positioning shown in hard line in FIG. 2 and the top roll of deflector roll unit 30 goes into its phantom or defelctor roll position shown in FIG. 2. Arm assembly 60 will be moved in its ambushed position below the passline as seen in hard line in FIG. 2. Conventionally, the pinch roll unit 28 always retains the leading end preventing it from entering the furnace 12. Coiler drum 32 is then rotated in a direction which will cause the trailing end of workpiece 16 to move to the left of FIG. 2 for a coiling operation to be performed on the coiler drum located to the left of mill 10 of FIG. 1. It is to be emphasized that during the flat passes of workpiece 16 through the mill 10, arm assembly 60 is located in its hardline positioning below table assembly 18, which assembly 18 is in line with passline 20. During the coiling of workpiece 16 onto drum 32 or onto the drum located to the left of mill 10 in FIG. 1, arm assembly 60 is located above the passline for its desired cooperation with drum 32.

Other important advantages of the invention are that the wrapper rollers 82, 90, and 92 of arm assemblies 58 and 60, during overwinding and underwinding respectively, prevent slippage of the leading end of workpiece 16 out of the slot of drum 32 before the initial wrap around drum 32 is completed. Also, overheating of the table rollers, which conventionally are located and remain beneath the coiler furnace 12, is eliminated since these table rolls, which are now part of table assembly 18, can be moved away from the furnace during the coiling operation or during an idle time of the mill. The arm assemblies 58 and 60 may also be moved out during idle time.

Whereas a particular embodiment of the invention has been described above for purposes of illustration, it will be evident to those skilled in the art that numerous variations of the details may be made without departing from the invention as defined in the appended claims.

In accordance with the patent statutes, we have explained the principle and operation of our invention and have illustrated and described what we consider to be the best embodiment thereof.

We claim:

1. In a hot reversing mill for reducing a workpiece and having a rotatable coiler drum on a side thereof for coiling and uncoiling said material traveling along a passline defined by a series of table rolls, said coiler drum located above said passline and having a material receiving slot positionable in a predetermined angular position relative to the rotation of said drum for receiving the leading end of said material, said drum rotated in a desired direction for a winding operation, such as an overwinding or an underwinding of said material thereon, and comprising:

an apparatus in cooperation with said coiler drum comprising:

a shaft assembly located along said passline, a first and a second pivotal arm means mounted on said shaft assembly, means for pivoting said first and second pivotal arm means including means for positioning said first and second pivotal arm means close to said coiler drum above said passline for said winding operation of said material onto said drum, and means mounted on said each first and second pivotal arm means for engaging said material to initially bend said material and subsequently wrapping said material onto said coiler drum for said overwinding or underwinding operation of said material, said means for engaging said material comprising first roller assembly means on said first pivotal arm means located upstream of and near said slot when in said predetermined angular position for said underwinding operation and second roller assembly means on said second pivotal arm means located on a side of and close to said slot opposite to that which said first roller assembly means is located downstream of said slot when in said predetermined angular position for said underwinding operation, said means for pivoting said first and second pivotal arm means further includes means for independently and selectively positioning said first roller assembly means away from said coiler drum for supporting and guiding said material onto said coiler drum when in a different said predetermined angular position for said overwinding operation.

2. In a hot reversing mill according to claim 1, further comprising:

a table roll assembly associated with said coiler drum including means for selectively positioning said table roll assembly perpendicularly relative to said passline to become part of said series of table rolls during flat reverse passes of said material through said mill and out of said passline away from said coiler during said winding operation of said material onto said coiler drum.

3. In a hot reversing mill according to claim 2, further comprising said means for selectively positioning said table roll assembly in the same location as at least one of said first and second pivotal arm means relative to said passline, and wherein said means for pivoting said first and second pivotal arm means includes means for independently positioning said at least one of said first and second pivotal arm means below said passline in a remote location to allow said positioning of said table roll assembly in said same location in said passline thereby allowing said table roll assembly to become part of said series of table rolls.

4. In a hot reversing mill according to claim 2, wherein said table roll assembly comprises a plurality of motor operated rotatable rolls, and wherein said means for selectively positioning said table roll assembly includes rail means arranged perpendicularly with respect to said passline for supporting said table roll assembly and a piston cylinder assembly connected to said table roll assembly.

5. In a hot reversing mill according to claim 1, further comprising pivotal apron means arranged along said passline in close proximity to said coiler drum for supporting and guiding said workpiece along said passline and selectively out of said passline and onto said coiler drum, and wherein one of said first and second pivotal arm means remains in an extended position above said passline and includes two spaced-apart arm members for receiving said apron means therebetween for unrestricted pivotal movement of said apron means relative to said passline.

6. In a hot reversing mill according to claim 1, and having a furnace, wherein said rotatable drum is located in said furnace, wherein said shaft assembly of said apparatus is located outside and below said furnace, and wherein said first and second pivotal arm means are further adapted to be positionable out of said furnace.

7. In a reversing mill according to claim 1, wherein said first roller assembly means consists of a single roller and said second roller assembly means comprises an arc-shaped pivotal cradle and at least two rollers mounted on the ends of said cradle.

8. In a reversing mill according to claim 1, wherein for said underwinding operation said first roller assembly is located near a fourth quadrant of said drum and said second roller assembly is located near a first quadrant of said drum.

9. In combination with a hot reversing mill system for reducing strip like material having a furnace including an internal rotatable coiler drum arranged to receive material from said mill for coiling said material traveling along a passline coincidental with a series of table rolls which on certain instances support the material passing under said coiler drum, said coiler drum rotating in a direction for underwinding said material thereon, said drum having a material receiving slot positionable in a predetermined angular position relative to the rotation of said drum for receiving the leading end of said material, an apparatus comprising:

a pair of wrapper rollers arranged to have an inoperative position away from said drum below said table rolls and an operative position adjacent a portion of said drum and closely behind said slot when said slot is in its said material receiving position and with reference to the underwinding direction of rotation of said drum, means for mounting said wrapper rollers in a spaced arcuate relationship to said drum to effect a bending action on the material substantially immediately behind said slot when said slot is in its said material receiving position, and means for moving said wrapper rollers into and out of said inoperative and operative positions, means for mounting said table rolls in a manner to be retracted away from beneath said drum to permit said movement of said wrapper rollers in said inoperative and operative positions, and the removal of said table rolls away from the heat of said furnace during the coiling operations, and means for moving said table rolls beneath and from beneath said drum.

10. In combination according to claim 9 wherein said apparatus includes a third wrapper roller arranged on the side of said slot when in its said material receiving position opposite to the said position of said pair of wrapper rollers relative to said slot, and means for selectively positioning said third wrapper roller closely adjacent to said slot.

11. In combination with a hot reversing mill system for reducing strip like material having a furnace including an internal rotatable coiler drum arranged to receive material from said mill for coiling said material traveling along a passline, said coiler drum rotating in a direction for underwinding said material thereon, said drum having a material receiving slot positionable in a predetermined angular position relative to the rotation of said drum for receiving the leading end of said material, and apparatus comprising:

a pair of wrapper rollers arranged to have an inoperative position away from said drum and an operative position adjacent a portion of said drum and closely behind said slot when said slot is in its said material receiving position and with reference to the underwinding direction of rotation of said drum, means for mounting said wrapper rollers in a spaced arcuate relationship to said drum to effect a bending action on the material substantially immediately behind said slot when said slot is in its said material receiving position, and means for moving said wrapper rollers into and out of said inoperative and operative positions.

12. In a combination according to claim 11, wherein said apparatus includes a third wrapper roller arranged on the side of said slot when in its said material receiving position opposite to the said position of said pair of wrapper rollers relative to said slot, and means for selectively positioning said third wrapper roller closely adjacent to said slot.

13. In a hot reversing mill for reducing a workpiece and having a rotatable coiler drum on a side thereof for coiling and uncoiling said material traveling along a passline defined by a series of table rolls, said coiler drum rotated in a desired direction for a winding operation of said material thereon, and comprising:

an apparatus in cooperation with said coiler drum comprising:

a shaft assembly located along said passline, a first and a second pivotal arm means commonly mounted on said shaft assembly and positionable near and away from said coiler drum along different locations of said drum, and arranged to extend on opposite sides of said drum and travel in a different arcuate path for said positioning relative to said coiler drum, means for pivoting said first and second pivotal arm means including means for said positioning of said first and second pivotal arm means close to said coiler drum above said passline for said winding operation of said material onto said drum, means mounted on said each first and second pivotal arm means for engaging and bending said material initially and subsequently wrapping said material onto said coiler drum for said winding operation of said material, and a table roll assembly associated with said coiler drum including means for selectively positioning said table roll assembly in the same location as at least one of said first and second pivotal arm means relative to said passline and along said passline to become part of said series of table rolls during flat reverse passes of said material through said mill and out of said passline during said winding operation of said material onto said coiler drum, said means for pivoting said first and second pivotal arm means includes means for independently positioning said at least one of said first and second pivotal arm means below said passline in a remote location to allow said positioning of said table roll assembly in said same location in said passline thereby allowing said table roll assembly to become part of said series of table rolls.

14. In a hot reversing mill for reducing a workpiece and having a rotatable coiler drum on a side thereof for coiling and uncoiling said material traveling along a passline defined by a series of table rolls, said coiler drum rotated in a desired direction for a winding operation of said material thereon, and comprising:

an apparatus in cooperation with said coiler drum comprising:

a shaft assembly located along said passline, a first and a second pivotal arm means commonly mounted on said shaft assembly and positionable near and away from said coiler drum along different locations of said drum, and arranged to extend on opposite sides of said drum and travel in a different arcuate path for said positioning relative to said coiler drum, means for pivoting said first and second pivotal arm means including means for said positioning of said first and second pivotal arm means close to said coiler drum above said passline for said winding operation of said material onto said drum, means mounted on said each first and second pivotal arm means for engaging and bending said material initially and subsequently wrapping said material onto said coiler drum for said winding operation of said material, a table roll assembly associated with said coiler drum including means for selectively positioning said table roll assembly along said passline to become part of said series of table rolls during flat reverse passes of said material through said mill and out of said passline during said winding operation of said material onto said coiler drum, said table roll assembly comprising a plurality of motor operated rotatable rolls, said means for selectively positioning said table roll assembly includes rail means arranged perpendicularly with respect to said passline for supporting said table roll assembly and a piston cylinder assembly connected to said table roll assembly.

15. In a hot reversing mill for reducing a workpiece and having a rotatable coiler drum on a side thereof for coiling and uncoiling said material traveling along a passline defined by a series of table rolls, said coiler drum rotated in a desired direction for a winding operation of said material thereon, and comprising:

an apparatus in cooperation with said coiler drum comprising:

a shaft assembly located along said passline, a first and a second pivotal arm means commonly mounted on said shaft assembly and positionable near and away from said coiler drum along different locations of said drum, and arranged to extend on opposite sides of said drum and travel in a different arcuate path for said positioning relative to said coiler drum, means for pivoting said first and second pivotal arm means including means for said positioning of said first and second pivotal arm means close to said coiler drum above said passline for said winding operation of said material onto said drum, means mounted on said each first and second pivotal arm means for engaging and bending said material initially and subsequently wrapping said material onto said coiler drum for said winding operation of said material, apron means arranged along said passline in close proximity to said coiler drum for supporting and guiding said workpiece along said passline and selectively out of said passline and onto said coiler drum, one of said pivotal arm means in said positioning above said passline comprising two spaced-apart arm members for receiving said apron means therebetween for unrestricted pivotal movement of said apron means relative to said passline.

16. In a method of coiling strip like material on a rotating drum in an underwinding fashion in which the drum is provided with a slot for receiving the leading end of said material, which slot is predeterminedly positioned for said receiving of said material, the steps comprising:

engaging at least the first wrap of said material on said drum by at least two spaced apart wrapper rollers in a manner to engage and bend the material around said drum at a position closely adjacent to and behind said slot in said drum with reference to said material receiving position thereof and to said underwinding direction of rotation of said drum, and engaging said first wrap of said material on said drum with a third wrapper roller at a point on said drum on the side of said slot when in its said material receiving position opposite the position of engagement of said pair of wrapper rollers and substantially close to said slot.

17. In a method according to claim 16 wherein said drum is mounted in a furnace and the arrangement includes a roller table arranged below said drum for supporting in certain instances the material passing under said drum, the additional step comprising:

mounting said two spaced apart wrapper rollers below said roller table in a manner that said spaced apart wrapper rollers have an inoperative position below said roller table and an operative material engaging position, and moving said roller table to a position away from beneath said drum to allow said spaced apart wrapper rollers to move to and from said operative and inoperative positions and to allow removal of said roller table from the heat of said furnace during the coiling operation.

18. In a method of coiling strip like material on a rotating drum in an underwinding fashion in which the drum is provided with a slot for receiving the leading end of said material, which slot is predeterminedly positioned for said receiving of said material, said drum mounted in a furnace, and the arrangement including a roller table arranged below said drum for supporting in certain instances, the material passing under said drum, the steps comprising:

engaging at least the first wrap of said material on said drum by at least two spaced apart wrapper rollers in a manner to engage and bend the material around said drum at a position closely adjacent to and behind said slot in said drum with reference to said material receiving position thereof and to said underwinding direction of rotation of said drum, mounting said two spaced apart wrapper rollers below said roller table in a manner that said spaced apart wrapper rollers have an inoperative position below said roller table and an operative material engaging position, and moving said roller table to a position away from beneath said drum to allow said spaced apart wrapper rollers to move to and from said operative and inoperative positions and to allow removal of said roller table from the heat of said furnace during the coiling operation.

19. In a method of coiling strip like material on a rotating drum rotated in a desired direction for an underwinding or an overwinding operation, which drum is provided with a slot for receiving the leading end of said material, which slot is predeterminedly positioned for said receiving of said material, for an underwinding operation the steps comprising:

positioning a first and a second arm means close to said drum wherein said second arm means comprises at least two spaced apart wrapper rollers and said first arm means comprises a third wrapper roller, engaging at least the first wrap of said material on said drum by said at least two spaced apart wrapper rollers in a manner to engage, bend, and hold the material on said drum at a position closely adjacent to and behind said slot in said drum with reference to said material receiving position thereof, and engaging said first wrap of said material on said drum with said third wrapper roller at a point on said drum on the side of said slot when in its said material receiving position opposite the position of engagement of said pair of wrapper rollers and substantially close to said slot;

and for an overwinding operation, the steps comprising:

positioning said first arm means away from said drum to support and guide said material into said slot with reference to said material receiving position thereof and around said drum.

* * * * *